United States Patent [19]

Smith

[11] 4,079,849

[45] Mar. 21, 1978

[54] REFUSE COMPACTOR

[75] Inventor: Fred T. Smith, Palos Verdes, Calif.

[73] Assignee: Sargent Industries, Inc., Los Angeles, Calif.

[21] Appl. No.: 804,633

[22] Filed: Jun. 8, 1977

Related U.S. Application Data

[62] Division of Ser. No. 584,299, Jun. 6, 1975, Pat. No. 4,042,133.

[51] Int. Cl.[2] ..... B65F 3/00

[52] U.S. Cl. ..... 214/152

[58] Field of Search ..... 214/152, 83.3, 82; 100/189, 233, 269 R

[56] References Cited

U.S. PATENT DOCUMENTS

| | | | |
|---|---|---|---|
| 3,092,269 | 6/1963 | Brown | 214/83.3 |
| 3,881,613 | 5/1975 | Torimoto et al. | 214/83.3 |

*Primary Examiner*—Albert J. Makay

*Attorney, Agent, or Firm*—Ellsworth R. Roston

[57] ABSTRACT

A method for packing refuse which comprises moving a foldable packing member from a folded rest position to an unfolded working condition within a refuse hopper then moving the packing member in an unfolded condition through the refuse hopper to move refuse from the hopper. Following this, the movement of the packing member is reversed to move the packing member in a partially folded condition through the hopper to return the packing member to its folded rest position.

11 Claims, 7 Drawing Figures

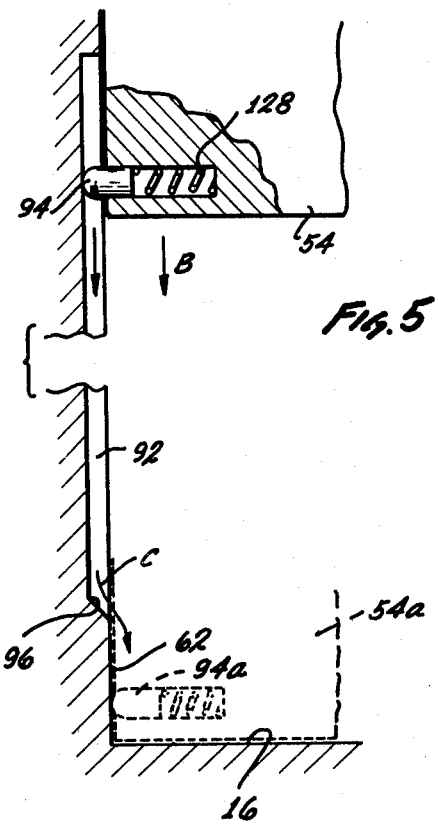
Fig. 5
Fig. 6
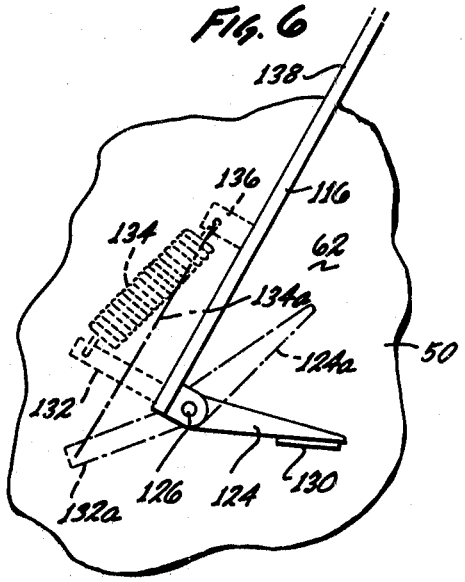
Fig. 7
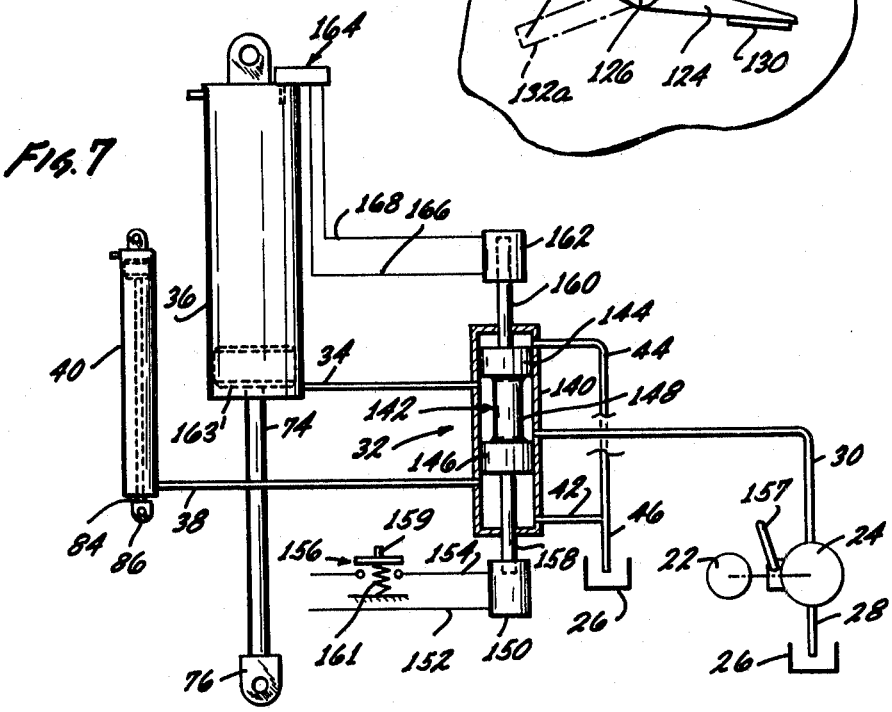

REFUSE COMPACTOR

This is a division of application Ser. No. 584,299 filed June 6, 1975, now Pat. No. 4,042,133.

BACKGROUND OF THE INVENTION

As a society becomes more industrialized and its citizens attain a higher standard of living, there is a rapid increase in the quantity of disposable refuse. As a consequence, the refuse collection industry is undergoing rapid growth in industrialized countries.

In the collection of refuse, the refuse is compacted within a storage body to densify the refuse and to make it easier to transport, etc. The refuse is, thus, initially dumped into a loading hopper and is then swept from the hopper by the movement of a packing mechanism which sweeps through the hopper. As the packing mechanism sweeps through the hopper, the refuse may be moved from the hopper into a passage leading to a refuse storage body.

In an initially empty condition, a refuse storage body will have an initial volume which is greater than the volume refuse being moved into the storage body from a loading hopper. Thus, refuse which is initially moved into the storage body will be relatively uncompacted while refuse that is moved into the storage body when the storage body is essentially full will be highly compacted. This will produce a non-uniform density of refuse within the storage body as the storage body is filled with the storage body, thus, not containing its full capacity of refuse.

To prevent non-uniform compaction of refuse within a storage body, it is common practice to mount a movable compaction panel within the storage body with the refuse being packed against the compaction panel. When the refuse storage body is empty, the compaction panel is moved to a position adjacent the passage leading into the storage body to reduce the available volume of the storage body. Refuse which is received from the loading hopper is then packed against the compaction panel. When sufficient refuse has been packed against the compaction panel to provide a given densification of the refuse, as indicated by the total force exerted by the refuse against the compaction panel, the compaction panel is then moved a slight distance in a direction leading away from the passage into the storage body. This provides an increase in the effective volume of the refuse storage body and additional refuse is then moved into the storage body and packed against the compaction panel. Packing is continued until the refuse within the storage body again attains a given density as measured by the force exerted against the compaction panel by the refuse. At this point, the compaction panel is again moved to incrementally increase the effective volume of the refuse storage body. By, thus, moving the compaction panel in small increments to incrementally increase the volume of the refuse storage body, the refuse is compacted uniformly as the storage body is progressively filled. This continues until the compaction panel has moved to its forward-most position within the storage body and the storage body is filled with refuse.

In moving a compaction panel within a storage body to provide uniform densification of the refuse as it is packed into the storage body, the compaction panel may be supported within the storage body by means of a telescoping hydraulic cylinder. With the telescoping cylinder in an extended position, the compaction panel is positioned adjacent the point where refuse enters the storage body. As the storage body is progressively filled with refuse and the compaction panel is moved forwardly in small increments, the telescoping cylinder may be proressively contracted until the cylinder is completely contracted with the compaction panel in its forwardmost position.

In discharging refuse from a refuse storage body after the body has been filled, the loading hopper and its associated packing mechanism may be pivotally mounted, in the form of a tailgate or like structure, with respect to the refuse storage body. The loading hopper and associated mechanism may, then, be pivoted away from the refuse storage body to provide an opening from the storage body for discharging refuse therefrom. With the loading hopper pivoted to provide an opening in the storage body, refuse may then be discharged by moving the compaction panel in a rearward direction toward the opening in the storage body to push the refuse from the storage body through the opening.

In a refuse packer, as described, the packing mechanism associated with the loading hopper is capable of producing a very large compaction force to density refuse as it is packed against the compaction panel within the refuse storage body. In previous refuse packers, the packing mechanism has generally been rotatably mounted with the packing mechanism undergoing full rotational movement during a single packing cycle. Thus, the packing mechanism in previous packers has been rotated to sweep refuse from a loading hopper during the power stroke of the packing mechanism with the packing mechanism being rotated forwardly and downwardly to a forward position with the hopper. The packing mechanism has then been rotated upwardly and rearwardly during the rearward movement of the packing mechanism.

The described complex movement of the packing mechanism in previous packers during a complete packing cycle has provided a packing movement that is relatively slow since considerable time may be lost during the upward and rearward rotation of the packing mechanism. It would, thus, be desirable if a packing mechanism could be provided which had a less complex movement so that less time would be lost in the movement of the packing mechanism throughout a complete packing cycle.

During the movement of a refuse packing mechanism through a complete packing cycle within a loading hopper, the demands on the packing mechanism will vary. As the packing mechanism begins the power stroke in sweeping refuse from the loading hopper, the powder demands on the packing mechanism are generally relatively low since the refuse being contacted may be in a loose uncompacted state. However, near the end of the power stroke there is generally a sharp increase in the power demands on the packing mechanism. At this point in the packing cycle, the refuse is no longer in a loose uncompacted state but, rather, is highly compacted as it is densified by forcing it against the compaction panel within the refuse storage body. After the refuse has been compacted against the compaction panel, the packing mechanism is then returned to its rest position generally through upward and rearward rotation within the loading hopper. During this portion of the packing cycle, the power demands on the packing mechanism are relatively slight since the packing mechanism is not working against the reaction force supplied by the densified refuse.

In meeting the varied demands on the packing mechanism, previous refuse packers have generally used a complex hydraulic control system coupled with hydraulic cylinders or motor means to move the packing mechanism through a complete cycle. During the initial movement of the packing mechanism in sweeping refuse from a loading hopper, it has been desirable to move the packing mechanism at a relatively high speed to reduce the time of the packing cycle. In accomplishing this result, the hydraulic control system for the packing mechanism generally functioned to supply a large volume of relatively low pressure hydraulic fluid to the motor means to provide a quick movement of the packing mechanism. Subsequently, when considerable resistance was encountered due to the reaction force of the compacted refuse, the hydraulic control system then functioned to increase the pressure of the hydraulic fluid fed to the motor means while additionally reducing the volume of this fluid. This decreased the speed of the packing mechanism while increasing the force which the packing mechanism applied against the refuse.

After completion of the power stroke of the packing mechanism, the hydraulic control means then functioned to again supply a large volume of relatively low pressure hydraulic fluid to the motor means. This provided a rapid upward and rearward rotation of the packing mechanism to its return position with the packing mechanism in position to begin a new power stroke.

In supplying the varied needs of a refuse packing mechanism during the various portions of a packing cycle, the hydraulic control systems have been relatively complex. This has increased the overall cost of the refuse packer. Also, the complexities of the hydraulic control systems have reduced the reliability of the refuse packers since reliability varies inversely with respect to complexity.

Another disadvantage of the previously used complex hydraulic control systems has been their need for hydraulic fluid whose flow rate and pressure must be varied during the packing cycle. To supply such varying needs of volume flow rate and pressure, it has previously been necessary to use a complex pumping arrangement which is capable of supplying either a high volume of a low pressure fluid or a low volume of a high pressure fluid. Further, the varying demands of a pump system in supplying a varying volume and varying pressure of hydraulic fluid has created problems by imposing diverse requirements upon the engine or motor that is used to operate the pump system. For example, if the pump used to supply hydraulic fluid for operation of the packing mechanism were driven by a truck engine (as in the case of a garbage truck), the truck engine may stall while attempting to power the pump in supplying high pressure fluid. Conversely, during the portions of the packing cycle which require a relatively large volume of hydraulic fluid, the truck engine may produce excessive noise from operating at a higher speed.

In view of the aforementioned difficulties resulting from complex hydraulic control systems and complex pumping arrangements as required for refuse packing mechanisms, it would be desirable if a packing mechanism could be devised which would satisfy the varying needs of the packing mechanism without requiring a complex hydraulic control system or a complex pump and engine combination. Moreover, it would be desirable to have a refuse packing mechanism which would operate satisfactorily from hydraulic fluid of a substantially constant flow rate and a substantially constant pressure. This would, then, eliminate the noise problem that may result when an engine must be operated at a high speed to operate the pump during a portion of the packing cycle.

SUMMARY OF THE INVENTION

In providing a solution to the aforementioned problems, the refuse packer of the present invention includes a refuse storage body, a loading hopper and a passage leading from the hopper to the storage body with a collapsible packing means mounted within the hopper. The packing means is movable from a collapsed rest position to an extended working condition to sweep refuse from the hopper into the passage. Also, however the packing means is movable in a partially collapsed condition in a return direction in returning to its collapsed rest position.

During movement of the packing means in a partially collapsed condition in returning to its rest position, the packing means is capable of partially collapsing to move over refuse within the loading hopper. Thus, the packing means, unlike the packing mechanisms of previous refuse packers, is not rotated upwardly and rearwardly through a full revolution in returning to a rest position. Rather, the packing means may be returned to its rest position merely by reversing its direction of movement through the loading hopper since the collapsible nature of the packing means permits it to pass over refuse within the hopper. By returning more directly to its rest position, the collapsible packing means may provide a faster packing cycle without the lost time previously required in raising the packing mechanism during its return movement to avoid contact with refuse within the loading hopper.

Additionally, the present refuse packer includes motor means which are drivingly connected to the packing means. The motor means function to move the packing means in an extended condition through the hopper and to then move the packing means in a partially collapsed condition through the hopper in a reverse direction in returning the packing means to its collapsed rest position.

In supplying the varied power needs of the refuse packer during a full packing cycle, the motor means has a power stroke and a return stroke. The power stroke of the motor means provides a larger force to the packing means while the return stroke of the motor means provides a faster movement to the packing means than its movement during the power stroke. Accordingly, the power transmitted to the packing means is increased when the packing means in its extended working condition in sweeping refuse from the hopper. However, the return stroke provides the packing means with an increased speed of movement as the packing means is moved in a partially collapsed position through the hopper in a reverse direction in returning the packing means to its collapsed rest position.

The refuse packer also includes guide means which extend into the hopper. The guide means function through contact with the packing means during movement of the packing means from its collapsed rest position to an extended working condition to sweep refuse from the hopper. A breaker surface may be defined by the packing means. The guide means is then shaped to move the breaker surface into contact with refuse within the loading hopper during movement of the packing means from its collapsed rest position to an extended working condition. In this manner, the breaker surface exerts a concentrated force on refuse that is contacted by the breaker surface as the packing means is moved from its collapsed rest position to an extended condition.

In the refuse packer of the invention, the collapsible packing means may comprise an upper panel and a lower panel which is hingedly connected to the upper panel. The hinged connection between the upper and lower panels may permit rotational movement of the lower panel with respect to the upper panel between an extended working condition with the upper and lower panels in generally aligned relation and a collapsed position in which the lower panel is folded relative to the upper panel. During movement of the upper and lower panels through the loading hopper in sweeping refuse from the hopper, the upper and lower panels may be maintained in a generally aligned relation by the force exerted against the lower panel by refuse in contact therewith. However, when the packing means is moved through the hopper in a reverse direction in returning the packing means to its collapsed rest position, the force exerted against the lower panel by refuse within the hopper may cause rotation of the lower panel to a partially collapsed or partially folded relation with respect to the upper panel.

In supplying power to the packing means, stroke converting means may be positioned between the motor means and the packing means. The stroke converting means may function to increase the force that is transmitted to the packing means from the motor means during its power stroke and to increase the speed of movement of the packing means during the return stroke of the motor means.

The motor means for the refuse packer of the invention may include a larger diameter hydraulic cylinder to transmit power to the packing means during the power stroke and a smaller diameter hydraulic cylinder to transmit power to the packing means during the return stroke. Thus, with a given flow rate of hydraulic fluid to operate the hydraulic cylinders, the hydraulic fluid produces a larger force and a slower movement as fluid is fed to the larger diameter cylinder and a smaller force and faster movement as hydraulic fluid is fed to the smaller diameter cylinder.

Preferably, the packing means is rotatably positioned within the loading hopper by means of a rotatable shaft. The packing means is connected to the shaft for rotational movement in an extended working condition through the hopper toward the passage leading to the refuse storage body and for rotational movement in a partially collapsed condition in a reverse direction in returning to its collapsed rest position. An eccentric drive member may be provided to connect the rotatable shaft to the larger diameter cylinder with the eccentric drive member being shaped to increase the torque transmitted from the larger diameter cylinder to the shaft as the packing means moves in an extended working condition through the hopper to sweep refuse from the hopper. Additionally, a second drive member may be provided to connect the rotatable shaft to the smaller diameter cylinder. Movement of the smaller diameter cylinder is then transmitted to the second drive member to cause rotational movement of the rotatable shaft as the collapsible packing means is rotated in a partially collapsed condition in a reverse direction during return of the packing means to its collapsed rest position.

A drive surface may be defined on the eccentric drive member and a second drive surface may be provided on the second drive member. A flexible drive member may then be provided to connect the drive surface to the larger diameter cylinder. The flexible drive member may then bear against the drive surface with the flexible drive member being wrapped or unwrapped with respect to the drive surface on rotational movement of the shaft during extension or contraction of the larger diameter cylinder.

A second flexible drive member may connect the second drive surface to the smaller diameter cylinder. The second flexible drive member may bear against the second drive surface with the second flexible drive member being wrapped or unwrapped with respect to the second drive surface on rotational movement of the shaft during extension or contraction of the smaller diameter cylinder. In a preferred form of the invention, both the flexible drive member and the second flexible drive member are link chain drives.

In the refuse packer of the invention, means may be provided in the passage leading to the refuse storage body to restrain the movement of refuse from the passage into the loading hopper. Thus, when the refuse is forced into the passage through movement of the packing means within the loading hopper, there is less tendency for the refuse to then undergo a reversal of its movement to move from the passage back into the loading hopper.

Control means are preferably included in the refuse packer to automatically reverse the direction of movement of the packing means after the packing means is moved through the hopper in an extended working condition to sweep refuse into the passage leading to the storage body. After reversal in the direction of movement of the packing means, the packing means may then automatically move in a reverse direction in returning the packing means to its collapsed rest position.

In addition to providing a refuse packer, as described, the present invention also provides a method for packing refuse. In accord with the method of the invention, a collapsible packing means is moved from a collapsed rest position to an extended working condition within a refuse loading hopper. The packing means is then moved in its extended working condition through the refuse loading hopper to sweep refuse from the hopper. Thereafter, the packing means is moved in a partially collapsed position in a reverse direction and is returned to its collapsed rest position. In moving the collapsible packing means through the refuse loading hopper, a large force may be applied to the packing means as it is moved in an extended working condition through the hopper. Thereafter, in moving the collapsible packing means in a reverse direction to its collapsed rest position, the speed of movement of the packing means may be increased since the movement of the packing means is not resisted by refuse within the loading hopper.

THE DRAWINGS

To further illustrate an embodiment of the invention, reference is made to the accompanying drawings in which:

FIG. 5 is a detailed elevational view in partial section illustrating the function of guide means in guiding the movement of the packing means between its collapsed rest position and its extended working condition;

FIG. 6 is a detail view of a refuse restraining member which is spring biased to an extended position within a passage to a refuse storage body to restrain the return of refuse from the passage to a loading hopper, and FIG. 7 is a schematic view of a hydraulic circuit for driving the packing means through a complete packing cycle.

DETAILED DESCRIPTION

Figure 1:
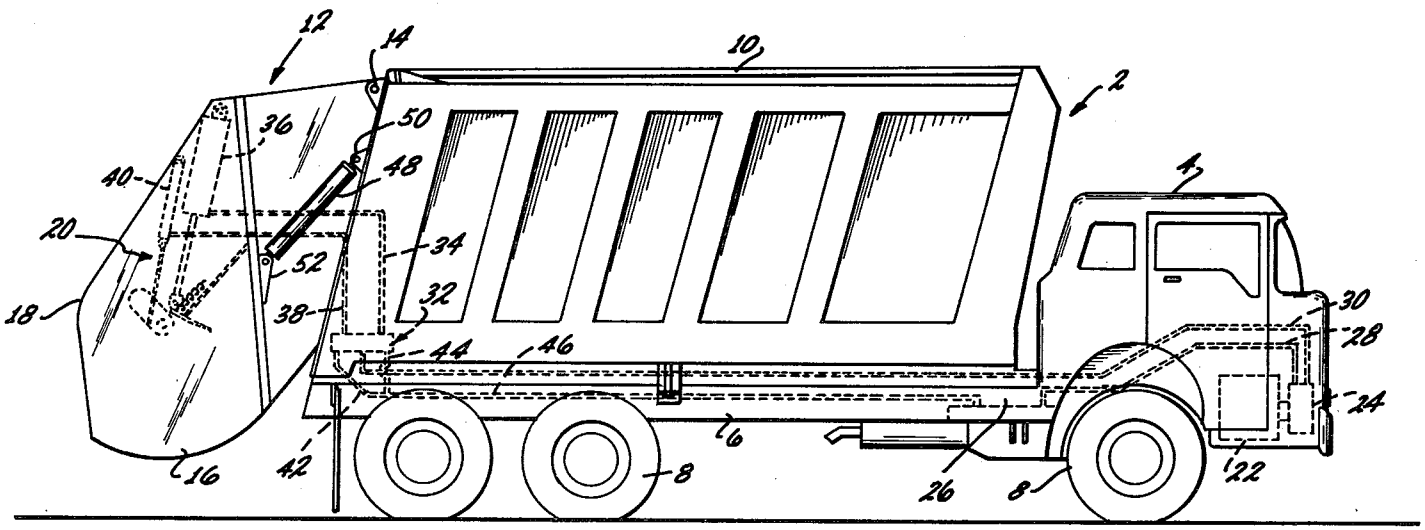
FIG. 1 is a side elevational view of a refuse packer of the invention mounted within a garbage truck.

FIG. 1 is a side elevational view illustrating a refuse packer of the invention installed on a refuse collection vehicle generally indicated as 2. The refuse collection vehicle 2 includes a cab 4 and a frame 6 which is supported on a plurality of wheels 8. Refuse storage body 10 is mounted on frame 6 and a tailgate 12 is pivotally connected to the storage body 10 through pivotal mountings 14 positioned on either side of the storage body. The tailgate 12 is shown in FIG. 1 in a lowered position relative to the storage body 10. As thus positioned, the lower portion of the tailgate 12 defines a loading hopper 16 into which refuse may be dumped through an opening 18 in the rear of the tailgate.

A refuse packing mechanism, generally indicated as 20, is mounted within tailgate 12 with the packing mechanism functioning, in a manner to be described, to sweep refuse from the loading hopper 16 into the refuse storage body 10. In providing power to operate the refuse packing mechanism 20, an engine 22, which may serve as the primary power source for the collection vehicle 2, may be drivingly connected to a pump 24. The pump 24 received hydraulic fluid from a sump 26 through a hydraulic line 28 and supplies hydraulic fluid to the packing mechanism 20 through line 30. Line 30 leads to a spool valve 32 which functions, as will be described, to supply hydraulic fluid through line 34 to a larger diameter hydraulic cylinder 36 or through line 38 to a smaller diameter hydraulic cylinder 40. When the packing mechanism 20 is sweeping refuse from loading hopper 16 into the storage body 10, the packing mechanism is powered by the larger diameter cylinder 36 which functions to supply a relative large force to the packing mechanism at a relatively slow speed. After the packing mechanism 20 has swept through the loading hopper 16, the packing mechanism is then moved in a reverse direction through the loading hopper by movement of the smaller diameter cylinder 40. Since the volume of the smaller diameter cylinder 40 is considerably less than that of the larger diameter cylinder 36, the movement of the smaller diameter cylinder is much more rapid than that of the larger diameter cylinder for a given flow rate of hydraulic fluid. According, the return movement of the packing mechanism 20 through the loading hopper 16 is relatively rapid, due to the smaller volume of cylinder 40, while the movement of the packing mechanism in sweeping refuse into storage body 10 is relatively slow due to the larger volume of cylinder 36.

A return branch 42 and a return branch 44 lead from opposite ends of valve 32 to a return line 46 leading to the sump 26. During forward movement of the packing mechanism 20 in sweeping refuse from hopper 16, hydraulic fluid is supplied to the larger diameter cylinder 36 through line 34. At the same time, hydraulic fluid is received from the smaller diameter cylinder 40 through line 38 and flows through valve 32 return line 46 to the sump 26. Conversely, during its return or reverse movement, the packing mechanism 20 is powered by the smaller diameter cylinder 40 which receives hydraulic fluid through line 38. At the same time, hydraulic fluid is received from the larger diameter cylinder 36 through line 34 and is returned to the sump 26 through valve 32 and return line 46.

As described, the varying needs of the packing mechanism 20 are supplied by the larger and smaller diameter cylinders 36 and 40 which, in the arrangement shown in FIG. 1, are operated by hydraulic fluid at a relatively constant flow rate and a relatively constant pressure. Thus, there is no need for a complex hydraulic control circuit or a complex engine and pumping arrangement as was required in previous refuse packers to vary the flow rate and pressure of hydraulic fluid during the various portions of the packing cycle. Additionally, since the packing mechanism 20 may be operated by hydraulic fluid at a relatively constant flow rate and a relatively constant pressure, the engine 22 may be operated at a relatively constant speed throughout the entire packing cycle. This results in less wear and tear on the engine 22 and also provides a much quieter operation since the engine does not have to be operated at high speeds during selected portions of the packing cycle.

When the refuse storage body 10 has become filled with refuse, the storage body may be empted by rotating the tailgate 12 upwardly in a clockwise direction about pivotal mountings 14 from its position shown in FIG. 1. This movement may be provided by the extension of a lifting cylinder 48 having one end pivotally connected through a bracket 50 to the refuse storage body 10 and its other end rotatably connected through a bracket 52 to the tailgate 12. On raising of the tailgate 12 to an elevated position with respect to the storage body 10, a rear opening is provided in the storage body and refuse within the body may then be discharged through the opening. After discharge of the refuse from storage body 10, the tailgate 12 may then be lowered through contraction of cylinder 48 with the tailgate serving to close the opening to the storage body 10. With the tailgate 12 in its lowered position relative to storage body 10, the tailgate may be locked through a conventional locking mechanism (not shown) with the locking mechanism being unlocked immediately prior to the raising of the tailgate to an elevated position.

Figure 2:
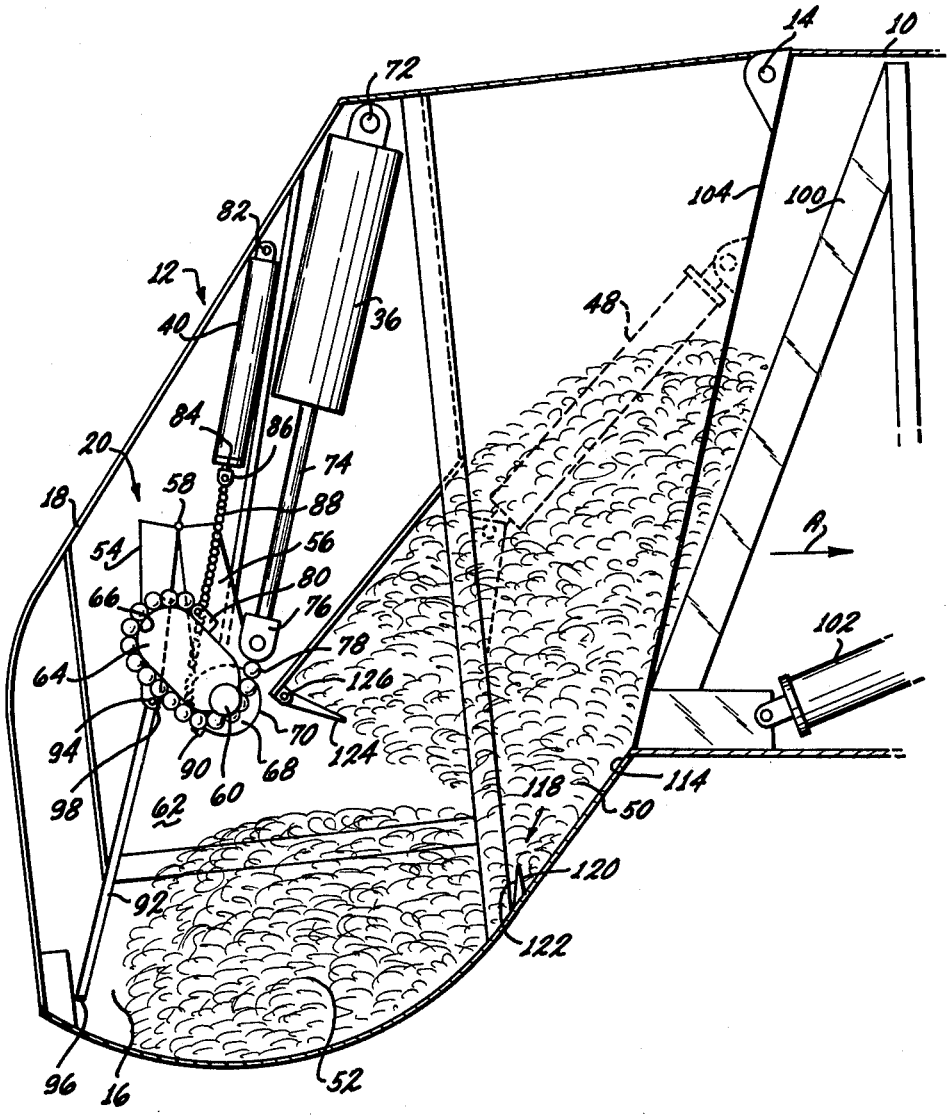
FIG. 2 is a side sectional view illustrating a collapsible packing means within a loading hopper with the packing means in a collapsed rest position above the hopper.

Turning to FIG. 2, which is a side sectional view through the tailgate 12, an upwardly inclined passage 50 leads from the loading hopper 16 to the refuse storage body 10. The packing mechanism 20 is positioned above the loading hopper 16 with the movement of the packing mechanism functioning to sweep refuse 52 from the loading hopper into passage 50 for movement into the storage body 10. The packing mechanism 20 includes a lower panel member 54 and an upper panel member 56 which are connected together through a hinge 58. The upper panel member 56 is connected to a rotatable shaft 60 which is positioned between side walls 62 of the tailgate 12. A cam member 64 having a drive surface 66 and a cam member 68 having a drive surface 70 are fixedly connected to the shaft 60. As will be described, the cam members 68 and 68 function to control the power supplied to the packing mechanism 20 and its speed of movement during a packing cycle.

The larger diameter cylinder 38 is pivotally connected to the tailgate 12 through a pivot 72 and includes a piston rod 74 having a connector 76 at its outer end. A link chain drive 78 is secured to the piston rod 74 through the connector 76 with movement of the piston rod thereby producing movement of the link chain drive. The other end of the link chain drive 78 is secured to the drive surface 66 of cam member 64 by means of a connector 80 with the link chain drive bearing against the drive surface 66. During contraction of the cylinder 36, there is a movement of the link chain drive 78 which is transmitted to the rotatable shaft 60 through drive surface 66 and the cam member 64. During rotation of the shaft member 60, the link chain drive 78 is then unwound with respect to drive surface 66 with the shape and position of the cam member 64 serving to control the speed of rotation and the torque applied to shaft 60 through movement of the larger hydraulic cylinder 26.

The smaller diameter hydraulic cylinder 38 is pivotally connected through a pivot 82 to the tailgate 12 with the smaller diameter cylinder having a piston rod 84. A connector 86 is formed at the outer end of piston rod 84 with the connector securing one end of a link chain drive 88 to the piston rod. The link chain drive 88 is secured at its outer end through a connector 90 to the drive surface 70 of cam member 68. During rotational movement of the shaft 60 together with cam member 68, the link chain drive 88 is in contact with drive surface 70 with the link chain drive being unwound with respect to drive surface 70 during contraction of the cylinder 40.

With the packing mechanism 20 in its collapsed rest position as shown in FIG. 1, the smaller diameter cylinder 40 is fully contracted while larger diameter cylinder 36 is fully extended. Both the cylinders 36 and 40 function to transmit power to the rotatable shaft 60 during their contraction strokes. After the packing mechanism 20 has functioned to sweep refuse from the loading hopper 16, as will be described, the packing mechanism is returned to its collapsed rest position of FIG. 1 by contraction of the smaller diameter cylinder 40, which movement is transmitted to rotatable shaft 60 through link chain drive 88, drive surface 70 and cam member 68. This causes shaft 60 to rotate in a clockwise direction as the packing mechanism 20 is moved rearwardly through the loading hopper 16 with the link chain drive 88 being progressively unwound from contact with the drive surface 70. When the rearward movement of packing mechanism 20 is completed, the cylinder 40 is completely contracted and the link chain drive 88 is almost completely unwound from contact with the drive surface 70.

During rearward movement of the packing mechanism 20, as described, the larger diameter hydraulic cylinder 36 is extended by the force applied to the larger cylinder through link chain drive 78. During rearward movement of the packing mechanism 20, the link chain drive 78 is progressively wound upon the drive surface 66 until, with the packing mechanism in its collapsed rest position shown in FIG. 1, the cylinder 36 is completely extended and the link chain drive 78 is almost completely wound upon the drive surface 66.

As illustrated in FIG. 1, the cam member 68 may have a circular configuration while the cam member 64 has an eccentric or elongated configuration. Due to the shape of the cam member 64 as compared with cam member 68, the distance around drive surface 66 is longer than the distance around drive surface 70. Accordingly, the movement experienced by the link chain drive 78 is greater than the movement of link chain drive 88 during the rotation of shaft 60. Also, the stroke of hydraulic cylinder 36 is greater than the stroke of hydraulic cylinder 40 to accommodate the greater movement of link chain drive 78 as compared with the movement of link chain drive 88. This relationship is of particular importance in the functioning of the refuse packer of the invention since it permits the application of great force to refuse within the hopper 16 during forward movement of the packing mechanism through the hopper while also permitting the reverse movement of the packing mechanism through the hopper at a relatively high rate of speed during return of the packing mechanism to its collapsed rest position shown in FIG. 1.

As indicated, the smaller diameter hydraulic cylinder 40 has a smaller volume than that of the larger diameter cylinder 36. Thus, assuming a source of hydraulic fluid which is supplied at a relatively constant flow rate and at a relatively constant pressure to cylinders 36 and 40 in providing movement of the packing mechanism 20, the hydraulic fluid will cause a relatively rapid contraction of smaller diameter cylinder 40 during the return of the packing mechanism through hopper 16 to the collapsed rest position of the packing mechanism. When hydraulic fluid is supplied at substantially the same flow rate and pressure to the larger cylinder 36 during forward movement of the packing mechanism 20 through loading hopper 16, the speed of contraction of the larger cylinder is relatively slow due to its larger volume. However, the force generated by contraction of the larger cylinder 36 is relatively large due to the larger surface area of the piston within the cylinder as compared with the area of the piston within cylinder 40. Thus, a relatively large force is supplied to the packing mechanism 20 during its forward movement through contraction of the larger diameter cylinder 36 which is transmitted to rotatable shaft 60 through link chain drive 78, contact surface 66 and cam member 64.

A guide slot 92 which may be formed in one of the side walls 62, contains a spring biased guide pin 94 that is mounted on the lower panel member 54. Through movement of the guide pin 94 within guide slot 92, the packing mechanism 20 moves in a predetermined path during its downward movement into the loading hopper 16 from the rest position of the packing mechanism shown in FIG. 2. With the packing mechanism 20 in a collapsed rest position at the beginning of a packing cycle, hydraulic fluid is fed to the larger diameter cylinder 36 to cause its contraction. The contraction of larger diameter cylinder 36 is communicated to the rotatable shaft 60 through piston rod 74, link chain drive 78 and contact surface 66. This causes the shaft 60 to rotate in a counterclockwise direction from its position shown in FIG. 1 to provide a downward movement of the packing mechanism 20 into the loading hopper 16 to reach the position shown in FIG. 3. During downward movement of the packing mechanism 20 into hopper 16 the guide pin 94 remains in engagement with guide slot 92 until the guide pin reaches the inclined portion 96 (see FIG. 2) which forces the guide pin out of engagement with the guide slot. During the remainder of the movement of the packing mechanism, as will be described, the guide pin 94 bears against one of the side walls 62 of the tailgate 12.

If desired, two guide pins 94 may be employed with the guide pins positioned at opposite sides of the lower panel 54. Each guide pin 94 then engages a guide slot 92 with the two guide slots positioned in opposing relation in the opposing side walls 62. Through the use of two guide pins 94 and two guide slots 92, the lower end of the panel 54 may be more uniformly supported during downward movement of the packing mechanism 20 from its collapsed rest position into the loading hopper 16.

As illustrated, a relatively sharp breaking surface 98 may be defined at the lower extremity of panel 54. During movement of the packing mechanism 20 in a downward direction into the loading hopper 16, the breaking surface 98 is moved downwardly into refuse within the loading hopper. The contact area between the breaking surface 98 and any refuse contacted thereby is relatively small due to the sharpened configuration of the breaking surface. Thus, on contact of the breaking surface 98 with refuse, a concentrated high shearing force is applied to the refuse. This is advantageous if the particular item of refuse which is contacted is relatively bulky such that the item of refuse could otherwise interfere with the movement of the packing mechanism 20.

A compaction panel 100 is slidably mounted within the refuse storage body 10 and refuse 52 which is moved through the passage 50 is packed against the compaction panel. The compaction panel 100 is supported within the refuse storage body 10 by a telescopic cylinder 102 which, in its extended condition, supports the compaction panel at a position adjacent to an opening 104 into the refuse storage body. As the refuse storage body 10 is progressively filled with refuse, the compaction panel 100 is progressively moved in the direction of the arrow A with the result that the refuse within the storage body has a relatively uniform density.

The forward movement of the compaction panel 100 which results from incremental contractions of the telescopic cylinder 102 may be controlled in response to the force exerted by the refuse 52 as it is packed against the compaction panel. When the force exerted by refuse 52 against the compaction panel 100 exceeds some predetermined force level, the force level being a measure of the densification of the refuse against the compaction panel, the compaction panel may then be moved a small distance in the direction of the arrow A through release of a small amount of hydraulic fluid from the telescopic cylinder 102. The forward incremental movement of the compaction panel 100 increases the effective volume of the refuse storage body 10, i.e., that volume which lies to the left of the compaction panel as viewed in FIG. 2 and which is available for the storage of refuse. This increase in volume reduces the force exerted by refuse 52 against the compaction panel with the force, thus, dropping below the predetermined force level. With the compaction panel 100 in its new position, additional refuse 52 may then be packed against the compaction panel until the force exerted by the refuse again reaches the predetermined force level with the compaction panel then moving a small incremental distance in the direction of the arrow A, etc.

When the refuse storage body 10 is filled with refuse, the lifting cylinder 48 may then be extended to rotate the tailgate 12 upwardly in a clockwise direction from its position shown in FIG. 2 about the pivotal mountings 14. With the tailgate 12 in a raised position, the telescopic cylinder 102 may be extended to move the compaction panel 100 in a rearward direction, opposite to the arrow A, which ejects the refuse from the storage body through opening 104. Following this, the tailgate 12 may then be lowered by contraction of the lifting cylinder 48 to close the opening 104 with the compaction panel 100 then being positioned rearwardly to contact the refuse as it is packed into the storage body 10.

The use of a compaction panel which is movably positioned within a refuse storage body to provide uniform densification of refuse within the body is not new and does not form a part of the present invention. Additionally, the use of a compaction panel to eject refuse from a storage body after the storage body is filled with refuse is not new. Thus, the present description of the compaction panel 100 and its movement within refuse storage body 10 is included as background information since the refuse packing mechanism 20 of the invention will frequently be used in conjunction with a compaction panel with the refuse packing mechanism functioning to pack refuse against the compaction panel.

Figure 3:
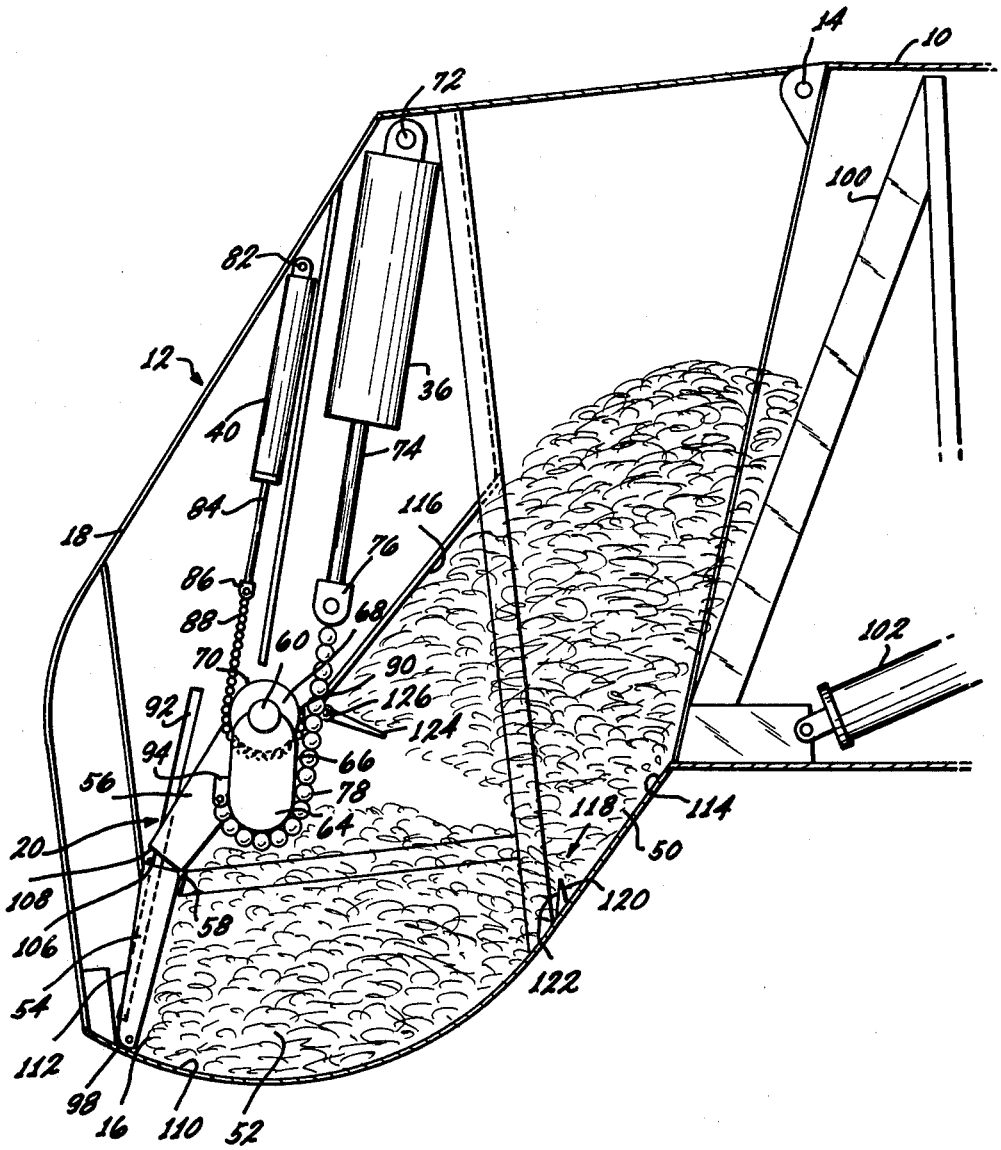
FIG. 3 is a side sectional view, similar to FIG. 2, illustrating the position of the collapsible packing means relative to the loading hopper after movement of the packing means from its collapsed rest position to an extended working condition.

After movement of the packing mechanism 20 in a downward direction to the disposition shown in FIG. 3, the lower panel 54 is generally aligned with the upper panel 56 through rotation of the lower panel with respect to the upper panel about hinge 58. With the lower and upper panels 54 and 56 in generally aligned relation as shown in FIG. 3, a stiffening surface 106 on the lower panel is in close proximity to a stiffening surface 108 on the upper panel. Also, the breaker surface 98 is positioned in close proximity to the hopper bottom 110. Also, as indicated, the larger diameter hydraulic cylinder 36 has undergone contraction with a portion of the link chain drive 78 being unwound from contact surface 66 in rotating the shaft 60 in a counterclockwise direction.

During contraction of the larger diameter hydraulic cylinder 36 to its position shown in FIG. 3, the smaller diameter hydraulic cylinder 40 has undergone expansion with the link chain drive 88 being progressively wound about the contact surface 70. The force transmitted to the smaller diameter cylinder 40 through piston rod 84, link chain drive 88 and contact surface 70 serves to expel hydraulic fluid from the smaller cylinder with the expelled fluid being conveyed to the sump 26 as described in regard to FIG. 1.

With the packing mechanism 20 in an extended condition as illustrated in FIG. 3, the cam member 64 is positioned in a generally downward direction with respect to the rotatable shaft 60. During continued rotation of shaft 60 in a counterclockwise direction from its position shown in FIG. 3, the long dimension of the cam member 64 is moved progressively into a horizontal position with the result that the torque applied to shaft 60 through the link chain drive 78 is progressively increased through an increase in the moment arm through which rotational force is applied to the shaft by the cam member.

The cam member 64, thus, functions to gradually increase the torque applied to rotatably shaft 60 as the panels 54 and 56 are moved in a forward direction through loading hopper 16. During forward movement of the panels 54 and 56 through loading hopper 16, the reaction force of refuse against the panels gradually increases. The increasing torque applied to shaft 60 through cam member 64 permits an increase in the force applied to panel members 54 and 56 in response to the rotational position of the cam member to supply a greater force to the panel members during the latter portion of their forward movement through the loading hopper 16.

As the panel members 54 and 56 are moved forwardly through loading hopper 16 from their position shown in FIG. 3, the reaction force of refuse within the hopper causes the panel member 54 to rotate slightly in a clockwise direction about hinge 58 until the stiffening surfaces 106 and 108 are brought into contact. At this point, the lower panel member 54 is rigidly positioned with respect to upper panel 56 and remains that way during the forward movement of the panels through loading hopper 16. It should be noted that when the panel members 54 and 56 are in their positions shown in FIG. 3, the rotational movement of the lower panel member in a counterclockwise direction with respect to the upper panel member about hinge 58 would not be resisted by the stiffening surfaces 106 and 108. Thus, when the panel members 54 and 56 are moved in a rearward direction within the hopper 16, the force of refuse against the back surface 112 of lower panel member 54 causes the lower panel member to partially fold with respect to the upper panel member 56 which permits the lower panel member to move over any refuse within the loading hopper.

As illustrated, the passage 50 includes passage walls 114 and 116 with a wedging member 118 being formed on the passage wall 114. As indicated, the wedging member 118 includes a surface 120 which is positioned at a relatively abrupt angle with respect to surface 114 and an inclined surface 122 which is positioned at a more gradual angle with respect to surface 120. The wedging member 118, thus, functions to permit refuse to slide over the inclined surface 122 as the refuse 52 is moved into passage 50 from the loading hopper 16. However, the abruptly angled surface 120 opposes the movement of refuse 52 in a reverse direction, i.e., from the refuse storage body 10 and passage 50 into the hopper 16. Thus, the wedging member 118 functions to prevent refuse 52 which has been moved from hopper 16 into passage 50 from falling back into the hopper.

A wedging member 124 is connected to the surface 116 through a pivot 126 with the wedging member being biased to its position shown in FIG. 3 in a manner to be described. With the wedging member 124 in its position shown in FIG. 3, the wedging member is locked in place to prevent refuse 52 from falling back into the hopper 16. However, the wedging member 124 may undergo rotational movement in the direction of wall 116 as refuse is moved from loading hopper 16 into passage 50. The wedging member 124, thus, functions to permit the movement of refuse into the passage 50 while preventing refuse from falling from the passage back into the hopper 16.

Figure 4:
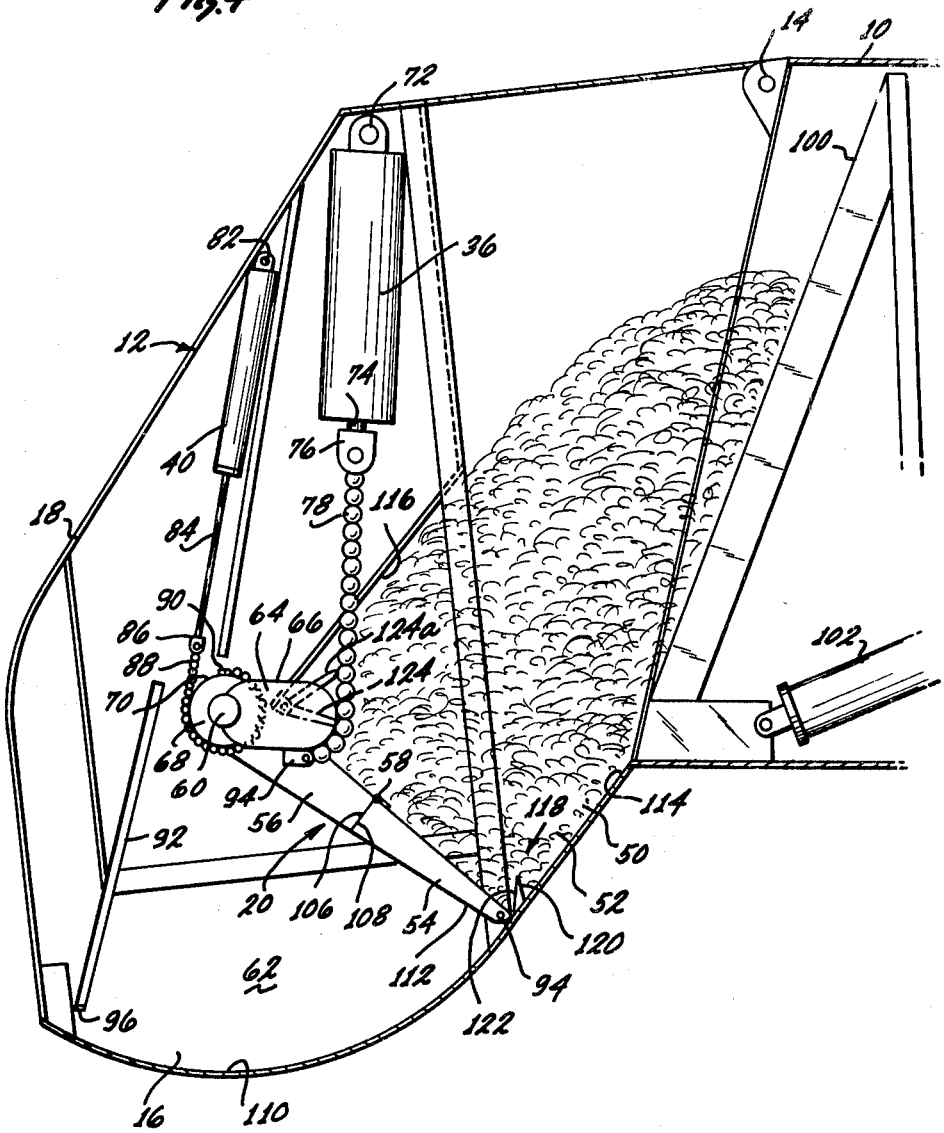
FIG. 4 is a side sectional view, similar to FIGS. 1 and 2, illustrating the position of the packing means at the end of its movement through the hopper in an extended working condition to sweep refuse from the hopper into a passage leading to a refuse storage body.

FIG. 4 illustrates the position of the panel members 54 and 56 in a generally aligned relation with the stiffening surfaces 106 and 108 in contacting relation which fixes the position of the lower panel member with respect to the upper panel member. After the panel members 54 and 56 have rotated completely through the hopper 16 as shown in FIG. 4, the larger diameter cylinder 36 is completely contracted and the torque applied to the shaft 60 through link chain drive 78 is at or near its maximum value due to the near horizontal position of cam member 64. During contraction of the larger diameter cylinder 36, the smaller diameter cylinder 40 has undergone expansion with the link chain drive 88 being wound upon the contact surface 70. The refuse 52 has, thus, been swept from the loading hopper 16 into the passage 50 for movement into the refuse storage body 10.

When panel members 54 and 56 have reached their forward position shown in FIG. 4, the flow of hydraulic fluid to the larger diameter cylinder 36 is then diverted to the smaller diameter cylinder 40 in moving the packing mechanism 20 from its position shown in FIG. 4 to its collapsed rest position shown in FIG. 2. During the movement of the packing mechanism 20 to its rest position, the direction of rotation of the shaft 60 is reversed in moving the packing mechanism 20 through refuse hopper 16 in a partially collapsed condition. The term "partially collapsed" refers to the fact that the lower panel member 54 can rotate in a counterclockwise direction about hinge 58 with respect to the upper panel member 56 as the panels are moved in a rearward direction through the hopper 16. Thus, refuse within hopper 16 which contacts the back surface 112 of the lower panel member 54 will cause the lower panel member to bend relative to the upper panel member 56 such that the lower panel member will pass over the refuse during its rearward movement.

During contraction of the smaller diameter hydraulic cylinder 40, the link chain drive 88 is unwound from contact surface 70 and shaft 60 is rotated in a clockwise direction from its position shown in FIG. 4. As indicated, contact surface 70 of cam member 68 has a length which is less than that of the contact surface 66 of cam member 64. The lesser length of contact surface 70 serves to increase the speed of movement of the packing mechanism 20 as it is moved in a reverse direction through the loading hopper 16. As described previously, the smaller volume of hydraulic cylinder 40, as compared with the volume of cylinder 36, also serves to accelerate the movement of the packing mechanism 20 in a reverse direction. The smaller diameter cylinder 40, thus, coacts with the contact surface 70 in providing a rapid return movement of the packing mechanism 20 through the loading hopper 16 in returning the packing mechanism to its collapsed rest position.

During its return movement, the packing mechanism 20 is not working against a large reaction force imposed by refuse in contact with the panel members 54 and 56. Thus, it is not necessary to transmit great force to the packing mechanism 20 during its return movement and it is, therefore, desirable that this movement be accomplished in the shortest practicable time in reducing the overall time for the packing cycle. In accomplishing this result, a source of hydraulic fluid at a relatively constant flow rate and a relatively constant pressure may be used to supply power to the hydraulic cylinders 36 and 40. This desirable result is, thus, achieved without the need for a complex hydraulic control system or a complex pumping arrangement as required in previous refuse compactors in which both the flow rate and pressure of the hydraulic fluid were varied to supply the varying needs of the packing mechanism during a complete packing cycle.

During the reverse movement of packing mechanism 20 through the loading hopper 16, the guide pins on the lower panel member 54 are in contact with the sidewalls 62 of tailgate 12. However, when the packing mechanism 20 has moved in a rearward direction to a position approximating that shown in FIG. 3, the guide pins, as will be described, engage the guide slot 92 and the packing mechanism is then moved in an upward direction to its collapsed rest position shown in FIG. 2. The lower panel member 54 is free to undergo counterclockwise rotation about the hinge 58 with respect to upper panel member 56 during the rearward movement of the packing mechanism 20. Thus, the precise position of panel members 54 and 56 when the guide pins 94 engage the guide slot 92 will vary depending upon the extent to which the lower panel member is folded relative to the upper penel member when the guide pins engage the guide slot.

As stated, the rotation of lower panel member 54 relative to upper panel member 56 permits the lower panel member to ride over refuse within the loading hopper 16 during rearward movement of the packing mechanism 20. Thus, the quantity of refuse within the loading hopper 16 during rearward movement of the packing mechanism 20 will determine the extent to which lower panel member 54 is rotated relative to upper panel member 56. This will, in turn, determine the position of the two panel members 54 and 56 when the guide pins 94 engage the guide slots 92. In any event, at some point during rearward movement of the packing mechanism 20, the guide pins 94 engage the guide slot 92. When this occurs, the continued rotation of shaft 60 results in raising of the packing mechanism 20 to its collapsed rest position shown in FIG. 2. As the packing mechanism 20 is, thus, being raised, its upward movement is determined by contact of the guide pins 94 with the guide slots 92.

The wedging member 124 is shown in two positions in FIG. 4. As indicated, when refuse 52 is moved into passage 50 during forward movement of the packing mechanism 20 through the loading hopper 16, the force of the refuse causes the wedging member to move to its position indicated as 124*a*. This permits refuse to move past the wedging member with the wedging member then returning to position 124 on the rearward movement of packing mechanism 20 to prevent movement of refuse from passage 50 back into loading hopper 16.

FIG. 5 is an enlarged partial sectional view which illustrates the movement of guide pins 94 relative to the guide slots 92. During the downward movement of lower panel member 54 in the direction of the arrow B, guide pins 94 which may extend from either side of the lower panel member are retained within guide slots 92 formed in the sidewalls 62 of tailgate 12. The guide pins 94 may each be biased outwardly by a spring 128 with the guide pins being forced into guide slots 92.

During the downward movement of the lower panel member 54, the guide pins 94 each engage the inclined portions 96 formed at the bottom ends of each of the guide slots 92. This causes the guide pins 94 to move inwardly against the springs 128 to a position indicated as 94*a* where the guide pins directly engage the sidewalls 62 of tailgate 12. During the continued forward movement of the packing mechanism 20, the guide pins occupy the position 94*a* with the pins in engagement with the sidewalls 62. However, during rearward movement of the packing mechanism 20, the guide pins 94 are again brought into registry with the guide slots 92 which then guide the upward movement of lower panel 54 in a direction opposite to arrow B to bring the lower panel into a folded relation which respect to the upper panel 56 in returning the packing mechanism 20 to its collapsed rest position shown in FIG. 2.

FIG. 6 is an enlarged detail view illustrating the functioning of the wedging member 124 in retaining refuse within the passage 50. With the wedging member in its extended position indicated as 124, the wedging member bears against a stop 130 which may be affixed in any suitable manner to one of the sidewalls 62 with the wedging member including an arm 132 that is engaged by a spring 134. The force of spring 134 upon the arm 132 maintains the wedging member in its position 124 with the wedging member extending into passage 50 to impede the movement of refuse from the passage into the loading hopper. As indicated, the upper end of the spring 134 may be held through engagement with a spring tab 136 which is affixed in any suitable manner to a wall 138 for the passage 50.

When refuse is introduced into passage 50, the refuse bears against the wedging member which undergoes rotational movement to a new position indicated as 124*a*. On rotation of the wedging member to position 124*a*, the arm which may be formed integrally with the wedging member is moved to a position 132*a* and causes extension of the spring to the position indicated by line 134*a*. With the spring in its extended condition indicated as 134*a*, there is a restoring force exerted on the arm in position 132*a* which returns the arm to position 132 when the packing mechanism 20 is moved in a rearward direction from its position shown in FIG. 4. At this point, the wedging member is returned to position 124 in contact with the stop 130 to prevent the reverse movement of refuse out of the passage 50.

FIG. 7 is a schematic view of a hydraulic control system for controlling the larger diameter cylinder 36 and smaller diameter cylinder 40 in the manner described. In supplying hydraulic fluid to cylinders 36 and 40, the spool valve 32 functions to direct hydraulic fluid first to larger diameter cylinder 36 to cause contraction of the larger cylinder while the smaller cylinder 40 is undergoing extension. At the end of the contraction stroke of the larger cylinder 36, the spool valve 32 automatically shifts to direct hydraulic fluid to the smaller diameter cylinder 40 to contract the smaller cylinder and return the refuse packing mechanism 20 to its collapsed rest position as described previously. The spool valve 32 includes a valve body 140 having a valve member 142 slidably positioned therein. The valve member 142 includes enlargements or spools 144 and 146 which are interconnected by a shaft 148. A solenoid 150 is positioned at one end of the valve body 140 with wires 152 and 154 leading to the solenoid and a switch 156 which in a closed position functions to supply current to the solenoid.

In beginning the packing cycle, the switch 156 is depressed by exerting a downward force on a rod 159 which overcomes the biasing force of a spring 161 that holds the switch in a normally open position as shown in FIG. 7. With switch 156 in a closed position, the solenoid 150 moves a push rod 158 to its position shown in FIG. 7 to shift valve member 142 to its illustrated position within valve body 140. The force on switch 156 is then released and the switch is returned to its open position by the force of biasing spring 161. A pump control 157 is then actuated to place the pump 24 in driving engagement with the engine 22. Hydraulic fluid is then pumped from the sump 26 through line 28 to the pump 24 and is expelled through line 30, valve 32 and line 34 to the larger diameter cylinder 36.

As hydraulic fluid is supplied to larger diameter cylinder 36, the smaller diameter cylinder 40 undergoes expansion as described previously and hydraulic fluid within the smaller cylinder is expelled through line 38, valve 32, branch return 42 and return line 46 to the sump 26. When the larger diameter cylinder 36 has completed its contraction stroke, a piston 163 is brought into contact with a switch 164 that is connected through wires 166 and 168 to a solenoid 162. The solenoid 162 is positioned adjacent an end of spool valve 32 which is opposite to the placement of solenoid 150. Solenoid 162 surrounds a push rod 160 for the valve member 142. On closing of switch 164, electrical current is supplied through wires 166 and 168 to the solenoid 162 which shifts the push rod 160 inwardly from its position shown in FIG. 7 and moves the valve member to an inward position within valve body 140.

With valve member 142 shifted inwardly, hydraulic fluid flows through line 30 into the annular space within valve body 140 which surrounds the shaft 148. The fluid is then conducted from spool valve 32 through line 38 to the smaller diameter cylinder 40 which causes the smaller cylinder to undergo contraction. As smaller diameter cylinder 40 contracts, the larger diameter cylinder 36 is extended as described previously to move the piston 163 away from switch 164 which is then returned to an open position. During contraction of the smaller cylinder 40 and extension of the larger cylinder 36, hydraulic fluid is received from the larger cylinder through line 34 and flows into the region within the valve body which is bounded by the upper surface of enlargement 144 when the valve member 142 is shifted to its inward position. The hydraulic fluid received from line 34 is, thus, discharged from valve body 140 through return branch 44, return line 46 and then to the sump 26.

On completion of the contraction stroke of smaller cylinder 40 and extension of larger cylinder 36, the packing mechanism 20 has been returned to its collapsed rest position shown in FIG. 2. The pump control 157 may then be actuated to disengage pump 24 from the engine 22 and the packing cycle is completed. If it is desired to repeat the packing cycle, this can be done simply by moving the switch 156 to a closed position to move the valve member 142 to an outward position while engaging the pump 24 with engine 22 through the pump control 157, etc.

In the schematic diagram illustrated in FIG. 7, the hydraulic lines have not been indicated for supplying fluid to the lifting cylinder 48 or telescopic cylinder 102 as referred to previously in regard to FIGS. 2–4. As described, it is conventional to use a lifting cylinder, such as cylinder 48, in moving the tailgate of a refuse collection vehicle between a raised and lowered position with respect to the refuse storage body. Also, it is conventional to use a telescopic hydraulic cylinder for controlling the movement of a compaction panel within the refuse storage body. Any of the various hydraulic control circuits of the prior art may, thus, be used for actuation of lifting cylinder 48 and actuation of the telescopic cylinder 102 as described in FIGS. 2–4. For example, the lifting cylinder 48 and the telescopic cylinder 102 may be controlled through use of hydraulic circuits of the general type disclosed in U.S. Pat. Nos. 3,410,427 and 3,556,324.

I claim:

1. A method of packing refuse in a hopper having an opening at its rear end for receiving the refuse and having an opening at its front end and of transferring the refuse into a storage body having at its rear end an opening communicating with the opening at the front end of the hopper to receive the refuse from the hopper, including the following steps:

providing in the hopper an upper packing panel and a lower packing panel attached to the upper packing panel in freely pivotable relationship to the upper packing panel;

providing a rotary movement of the upper packing panel in a direction from the rear end of the hopper toward the front end of the hopper;

providing an extended disposition of the lower packing panel relative to the upper packing panel, during the rotary movement of the upper packing panel in the direction from the rear end of the hopper toward the front end of the hopper, to obtain a transfer of refuse from the hopper into the storage body through the communicating openings in the hopper and the storage body;

providing a rotary movement of the upper packing panel in a direction from the front end of the hopper toward the rear end of the hopper; and providing a folding of the lower packing panel relative to the upper packing panel in response to the disposition of refuse against the lower packing panel or in response to gravity during the movement of the upper packing panel in the direction from the rear end of the hopper toward the front end of the hopper.

2. A method as set forth in claim 1 wherein a packing force of progressive magnitude is imposed upon the upper and lower packing panels during the rotary movement of the upper packing panel in the direction from the rear end of the hopper toward the front end of the hopper.

3. A method as set forth in claim 2 wherein the upper and lower packing panels are rotated at a relatively slow speed and are provided with a relatively large force in the direction from the rear end of the hopper toward the front end of the hopper and wherein the upper and lower packing panels are rotated at a relatively high speed and are provided with a relatively small force in the direction from the front end of the hopper toward the rear end of the hopper.

4. A method as set forth in claim 3 wherein the upper and lower packing panels are initially rotated at a relatively high speed during the movement of the packing panels forwardly as the lower packing panel becomes extended relative to the upper packing panel and wherein the upper and lower packing panels are then rotated forwardly in the hopper at a relatively low speed and a packing force of progressive magnitude is imposed upon the upper and lower packing panels during the rotaty movement of the upper packing panel forwardly in the hopper at the relatively low speed.

5. A method of transferring refuse from a hopper into a storage body where the hopper is disposed at the rear end of the storage body and the hopper and the storage body are provided with communicating openings and where the hopper is provided with an opening in its rear end for the transfer of the refuse into the hopper and is provided with a curved bottom wall for receiving the refuse transferred into the hopper and where an upper packing panel and a lower packing panel are disposed in the hopper and the lower packing panel is attached to the upper packing panel in freely pivotable relationship to the upper packing panel, including the following steps:

initially rotating the upper packing panel forwardly from the rear of the hopper;

providing for a full extension of the lower packing panel from the upper packing panel in a contiguous relationship with the bottom wall of the hopper during the forward rotation of the upper packing panel to obtain a transfer of the refuse from the hopper into the storage body;

subsequently rotating the upper packing panel rearwardly from the front of the hopper; and providing for a folding of the lower packing panel against the upper packing panel, initially by the refuse in the hopper and subsequently by gravity, during the rearward rotation of the upper packing panel.

6. A method as set forth in claim 5 wherein the torque on the lower packing panel is progressively increased during the forward rotation of the upper packing panel.

7. A method as set forth in claim 6 wherein the upper packing panel is rotated forwardly at a relatively low speed and with a relatively large torque on the lower packing panel and wherein the upper packing panel is rotated rearwardly at a relatively high speed and with a relatively low torque on the lower packing panel.

8. A method as set forth in claim 7 wherein the upper packing panel is initially rotated forwardly at a relatively high speed as the lower packing panel becomes extended relative to the upper packing panel and wherein the upper packing panel is subsequently rotated forwardly at a relatively low speed during the full extension of the lower packing panel and wherein the torque on the lower packing panel is progressively increased during the forward rotation of the upper packing panel at the relatively low speed.

9. A method of transferring refuse in a rear end loader from a hopper to a storage body disposed forwardly of the hopper and having an opening communicating with an opening in the hopper where upper and lower packing panels are disposed in the hopper and the lower packing panel is attached to the upper packing panel in freely pivotable relationship to the upper packing panel and the hopper is provided with a limited length, including the steps of:

moving the upper packing panel forwardly in a rotary path defined initially by a downward component and subsequently by an upward component;

providing an extension of the lower packing panel from the upper packing panel during the forward movement of the upper packing panel to obtain a transfer of the refuse from the hopper into the storage body through the communicating openings:

moving the upper packing panel rearwardly in a rotary path defined initially by a downward component and then an upward component; and providing for the folding of the lower packing panel against the upper packing panel by the refuse in the hopper during the rearward movement of the upper packing panel with the downward component and by gravity during the rearward movement of the upper packing panel with the upward component.

10. A method as set forth in claim 9 wherein the upper packing panel is initially moved forwardly in the hopper at a relatively high speed and the upper packing panel is subsequently moved forwardly in the hopper at a relatively low speed and with a progressively increasing force during the extension of the lower packing panel from the upper packing panel.

11. A method as set forth in claim 10 wherein the upper packing panel is subsequently moved rearwardly in the hopper at a relatively great speed and with a relatively small force.

* * * * *